US006702429B2

(12) United States Patent
Lin

(10) Patent No.: US 6,702,429 B2
(45) Date of Patent: Mar. 9, 2004

(54) INK CHAMBER STRUCTURE FOR AN INKJET PRINTHEAD

(75) Inventor: Chen-Hua Lin, Tou Lin (TW)

(73) Assignee: NanoDynamics Inc., Hsin Chu (TW)

( * ) Notice: Subject to any disclaimer, the term of this patent is extended or adjusted under 35 U.S.C. 154(b) by 0 days.

(21) Appl. No.: 10/227,870

(22) Filed: Aug. 27, 2002

(65) Prior Publication Data

US 2003/0058298 A1 Mar. 27, 2003

(30) Foreign Application Priority Data

Aug. 27, 2001 (TW) ..... 090121093 A

(51) Int. Cl.[7] ..... B41J 2/05; B41J 2/17
(52) U.S. Cl. ..... 347/65; 347/94
(58) Field of Search ..... 347/20, 56, 61, 347/63, 65, 67, 93, 94

(56) References Cited

U.S. PATENT DOCUMENTS 4,611,219 A * 9/1986 Sugitani et al. ..... 347/65
4,942,408 A * 7/1990 Braun ..... 347/63

* cited by examiner

*Primary Examiner*—Juanita Stephens
(74) *Attorney, Agent, or Firm*—Bacon & Thomas

(57) ABSTRACT

An ink chamber structure for an inkjet printhead, comprising a plurality of ink channels and a plurality of ink chambers arrayed in columns, with each of such plurality of ink chambers corresponding to an ink channel; the plurality of ink channels respectively channels ink from two sides of such column into ink chambers. The openings for part of the ink chambers are located on one side of the column installation, whereas the openings for the rest of the ink chambers are located on the other side of the column installation. By utilizing the cavity between two adjacent ink chambers on the same side to install an ink chamber from the other side, higher density of ink chamber installment can be achieved in the same scope of space. Also, with the ink chambers on the left and right sides being indentedly arranged, the ink chambers are provided with larger ink-inlet angles, thus effectively avoiding disturbance that adversely affects the reception of ink by the chambers.

12 Claims, 7 Drawing Sheets

INK CHAMBER STRUCTURE FOR AN INKJET PRINTHEAD

BACKGROUND OF THE INVENTION

1. Field of the Invention

The ink chamber structure for an inkjet printhead provides that the ink chambers are arrayed in columns, thus, with ink chambers being supplied with ink from two sides of the columns, the space available is efficiently utilized and the ink chambers are more closely arranged.

2. Description of the Related Art

In the era of information explosion with computer systems being widely used, not only has the frequent utilization of computers been increasing tremendously, but the performance and processing speed thereof are also strictly required. Therefore, the development of all the peripherals for computers are increasingly influenced by such everlasting trend that all kinds of novel peripherals are developed, with requirement for function and quality being renovated and improved. Within all the computer equipment, printers, the most prevalent and commonly used, are must-haves for computer users.

In view of the history of improvement for computer printers, three types thereof can be identified: dot matrix printers, inkjet printers and laser printers. Dot matrix printers are cheaper, but the drawbacks of slow printing speed and poor printing quality have already cost the dot matrix printers the competitive edge against either inkjet printers or laser printers on the market nowadays, with very few users still using such outdated equipment. Most consumers today use either inkjet printers or laser printers which respectively present desirable features and yet drawbacks as well, wherein first, as far as prices are concerned, inkjet printers are cheaper than laser printers, which is the advantage for inkjet printers; secondly, as far as the printing quality is concerned, inkjet printers provide inferior printing quality than laser printers, which is the advantage for laser printers.

Even though inkjet printers hold the price advantage over laser printers, in terms of the printing quality, however, the inkjet printers would lose the competitive edge against laser printers in applicable fields that require high printing quality. Generally speaking, since liquid is utilized as the printing material, not only shall ink cause diffusion, but certain natural characteristics of liquid shall also become flaws regarding the printing quality, e.g., the non-rigid body of the fluid, bubbles existed in fluid, and the flowing direction is difficult to control with the low viscosity coefficient of fluid.

Usually, the technologies concerning inkjet printing contain mechanisms used for controlling the release of ink from inkjet cartridges to the printing surface; based upon prior arts, a means of inkjet printing utilizes an inkjet printhead that, to be installed on the inkjet cartridge, ejects ink according to responses of the control signals.

Please refer to FIG. 1A and FIG. 1B. In the prior art, the inkjet printhead 94 of the inkjet cartridge 9 is usually consisted of three main structural layers: a silicon substrate 90 having a major surface, a barrier layer 91 connected to the major surface and constituted by ink channels that enable ink to flow from the inkjet cartridge to adjacent vaporization chambers, and the nozzle member 92.

The major surface of substrate of the inkjet printhead is installed with ink firing element 93 that, used for ejecting ink out of the ink chambers through nozzles, is mainly of thermal elements or piezoelectric elements, with two correspondent means of thermal bubble and piezoelectric pressure, such that the ink firing element 93 can heat or pressure ink up to cause ink to eject out.

The heating element of the thermal bubble inkjet printhead is of a thin-film resistor or heater; by heating ink up and thus vaporizing a small portion of ink instantly, the high-pressure bubble is to be produced and used for pushing ink to be ejected through nozzles. The piezoelectric element of the piezoelectric pressure printhead is of piezoelectric ceramic, from which voltage is applied to produce deformation, and with the responses from control signals to compress the volume of ink, the pressure wave is to be produced to force ink to be ejected through nozzles.

The ink-feeding outlets of inkjet printers are commonly having ink chambers as inkjet outlets wherefrom ink is to be ejected, thus the numbers of ink chambers naturally become the main factor concerning the printing quality.

In view of the fact that inkjet cartridges, usually designed to be tinier in volume, provide less and less space for installing ink chambers therein, the technological bottlenecks for inkjet improvement thus emerge, including the way of distributive arrangement for ink chambers and included angles of inlets of ink chambers, the two factors that cause significant effect on both the fluidity of ink when feeding ink and the clarification for the inkjet effects. The way of arrangement for ink chambers is though improved upon by prior arts, yet the improvement provided by prior arts that ink chambers are tightly arrayed for increasing the numbers of ink chambers shall cause unstable disturbance and air bubbles when feeding ink, thus causing unsmooth flow of ink, along with the drawback of low-resolution printing quality. The prior arts are introduced as follows:

The first prior arts, which is the most primordial art concerning the ink outlets and ink chambers of inkjet printers, adopts the central ink-feeding method, please refer to FIG. 2, wherein, S represents inkjet cartridge, with the ink-feeding outlet S1 installed at the bottom center of the printhead S; on the left of the ink-feeding outlet a plurality of ink chambers C1 are distributed, whereas on the right of the ink-feeding outlet a plurality of ink chambers C2 are distributed; the inkjet printer begins to heat ink up and eject ink out of inkjet printhead installed in ink chambers C1 and C2 once printing signals are received. Such central ink-feeding technology shall cause ink chambers C1 and C2 to interfere with each other by creating disturbance when ink is fed from the ink-feeding outlet S1 into ink chambers C1 and C2, for ink chambers C1 and C2 are closely adjacent with distance being very short between ink chambers C1 and C2. As a result, the ink density from ink-jetting shall not be even, thus words and graphics printed are so coarse that the printing quality is to be seriously compromised.

The second prior art is disclosed to improve upon the first prior art. Please refer to FIG. 3, wherein ink chambers are installed on the edges of both sides of the ink-feeding outlet S1, whereas on the left of the ink-feeding outlet a plurality of ink chambers C1 are installed, and on the right of the ink-feeding outlet a plurality of ink chambers C2 are installed. Such edge-feeding of ink does help to improve upon the disturbance caused by mutual interference from ink chambers C1 and C2 in the first prior art, yet the problem of disturbance still exists between adjacent ink chambers on the same side of the ink-feeding outlet S1, thus the effective solution is still unavailable to cope with the main source of interference in the first prior art.

The third prior art, also disclosed to improve upon the first prior art, adopts the ink chamber structure with tier arrangement. Please refer to FIG. 4, wherein ink chambers C11, C12 and C13 on the left are grouped in three wherein ink chambers are progressively terraced toward the left, whereas ink chambers C21, C22 and C23 on the right are correspondently structured to ink chambers C11, C12 and C13 on the left. Such kind of arrangement of ink chambers, different from that in the first prior art, might be able to stagger the positions of ink chambers C with the ink chamber structure being gradationally installed toward the two sides, thus decreasing the disturbance occurred between adjacent ink chambers C. Still, such way of arrangement is not tight enough, nor does it present the best solution for use of available space; therefore the drawbacks existed in the foregoing prior arts are still left unimproved.

Aside from the drawbacks existed in the three prior arts respectively, there is also a common drawback that still cannot be overcome, which is, because in the prior arts, the ink-inlet angles for ink chambers are tapered, such that the way of arrangement for ink chambers can be tighter, a plurality of ink chambers on the same side can be tightly adjacent, and the number of ink chambers within certain unit length can be maximized. Nonetheless, since the ink-inlet angles of ink chambers are so small that ink feeding becomes somewhat difficult, thus causing more serious disturbance. In view of the foregoing drawbacks caused by prior arts, the invention is therefore disclosed for the purpose of improving upon all the drawbacks in prior arts, upgrade the printing quality of ink-jet printers to compete with laser printers, and expand the market share with the advantage of cheaper price still intact.

SUMMARY OF THE INVENTION

The main object of the invention is to provide an ink chamber structure for an inkjet printhead. By utilizing the cavity between two adjacent ink chambers on the same side in one column to install an ink chamber from the other side, higher density of ink chamber installment can be achieved in the same scope of space, thus better printing quality is to be provided.

Another object of the invention is to provide larger ink-inlet angle for ink chambers by indentedly arranging the ink chambers on the left and right sides, thus effectively avoiding disturbance that adversely affects the feeding of ink into ink chambers.

The ink chamber structure of the preferred embodiment in the invention comprises a plurality of ink chambers arrayed in columns, and a plurality of ink channels, wherein each ink channel respectively corresponds to an ink chamber, and the plurality of ink channels respectively channels ink from two sides of such column into ink chambers.

In further preferred embodiment of the invention, the inkjet printhead comprises a substrate, a barrier layer having a plurality of ink chambers arrayed in at least one column, a nozzle member having a plurality of nozzles, with each nozzle corresponding to one ink chamber, and a plurality of ink channels, with each ink channel corresponding to one ink chamber, and the plurality of ink channels respectively channels ink from two sides of such column into ink chambers.

Wherein, openings for part of the ink chambers are installed on one side of the foregoing column installation, whereas the openings for the rest of the ink chambers are installed on the other side of the foregoing column installation. The foregoing ink channels correspond to the openings of the foregoing ink chambers, and the openings for adjacent ink chambers are respectively installed on two sides of the column installation.

BRIEF DESCRIPTION OF THE DRAWINGS

These and other features, aspects and advantages of the ink chamber structure for an inkjet printhead in the invention will become better understood with regard to the following description, appended claims and accompanying drawings that are provided only for further elaboration without limiting or restricting the present invention, where:

DETAILED DESCRIPTION OF THE PREFERRED EMBODIMENT

The following is a detailed description of the best presently known modes of carrying out the inventions. This description is not to be taken in a limiting sense, but is made merely for the purpose of illustrating the general principles of the inventions.

The invention relates to an ink chamber structure for an inkjet printhead, comprising a plurality of ink chambers arrayed in column, and a plurality of inkjet channels, with each ink channel corresponding to one ink chamber, and the plurality of ink channels respectively channels ink from two sides of such column into ink chambers. Openings for part of the ink chambers are installed on one side of the foregoing column installation, whereas the openings for the rest of ink chambers are installed on the other side of the foregoing column installation. The foregoing ink channels correspond respectively to the openings of the foregoing ink chambers, and the openings for adjacent ink chambers are respectively installed on two sides of the column installation.

Figure 1:
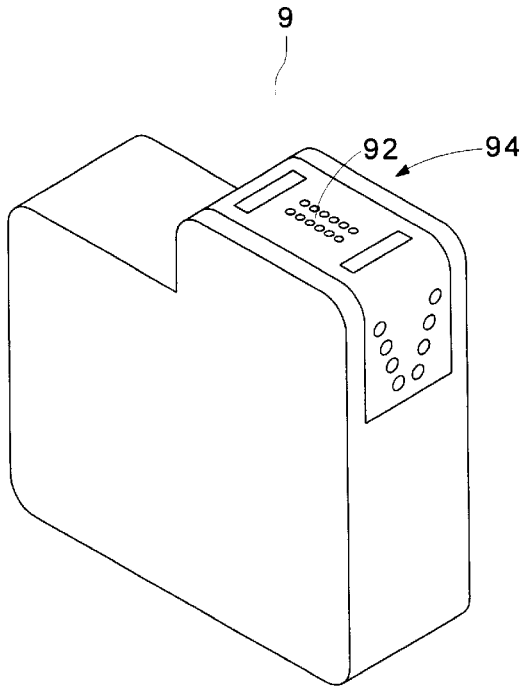
Fig.1 A PRIOR ART
FIG. 1A shows a diagram of the inkjet cartridge.
FIG. 1B shows a sectional view of the inkjet cartridge and the printhead.
Figure 1:
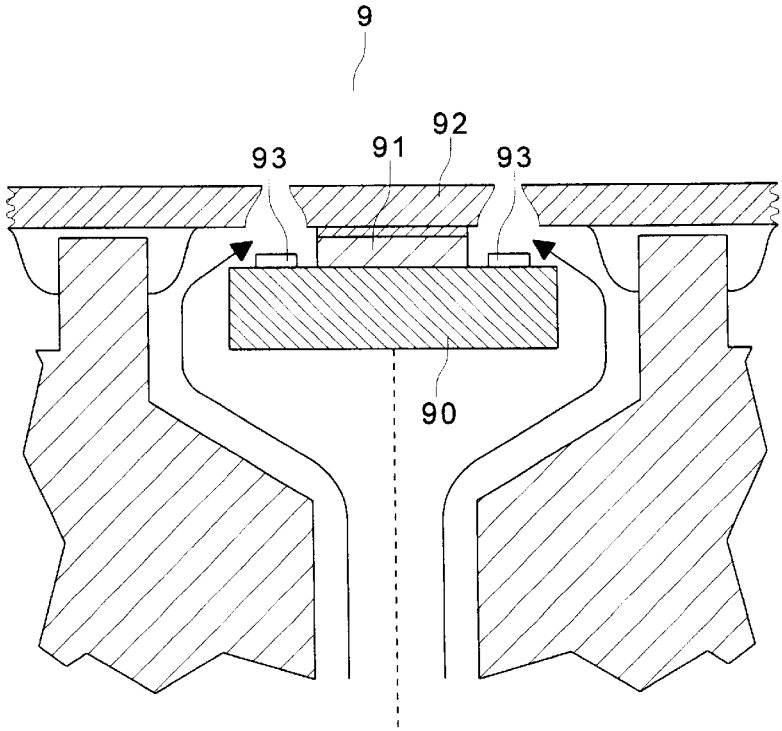
Fig.1 B PRIOR ART
Figure 2:
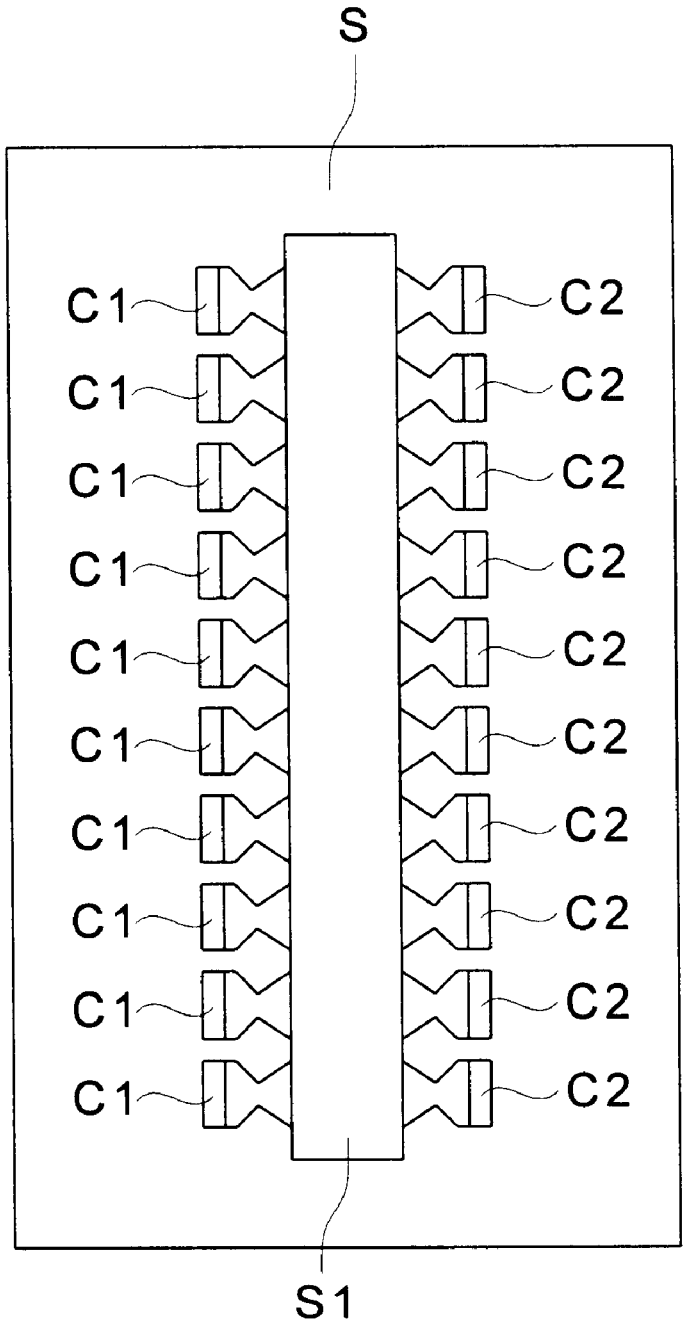
Fig.2 PRIOR ART
FIG. 2 shows a bottom plan view of the conventional inkjet cartridge (1)
Figure 3:
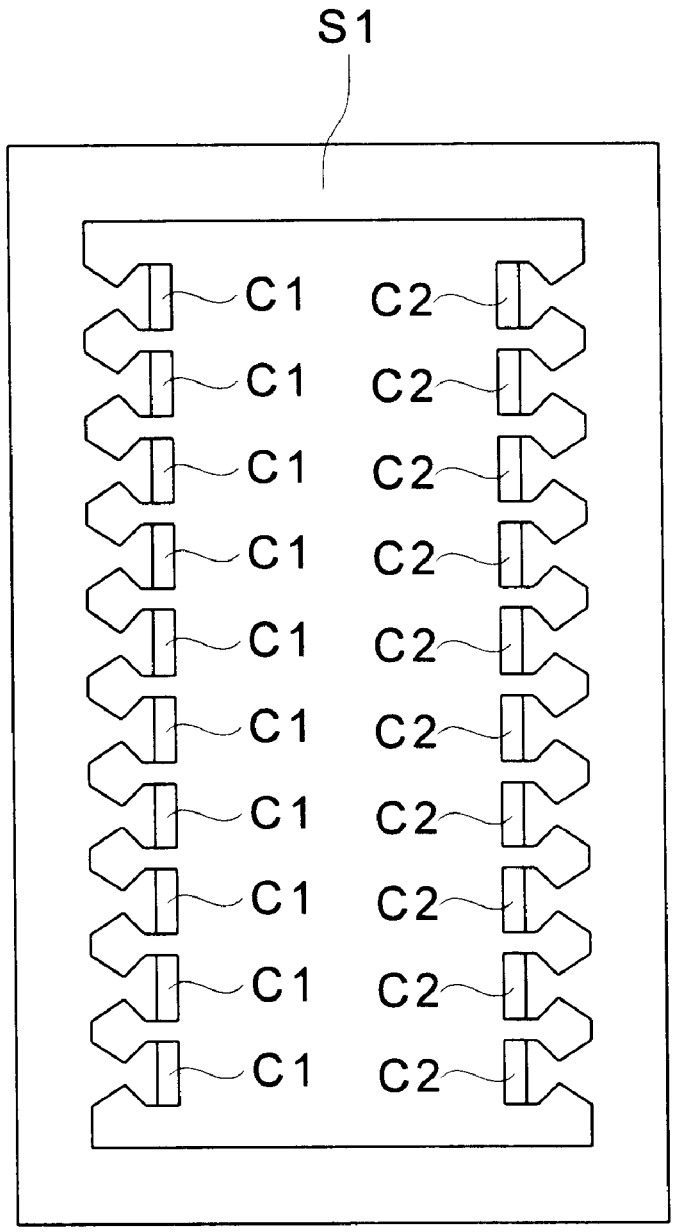
Fig.3 PRIOR ART
FIG. 3 shows a bottom plan view of the conventional inkjet cartridge (2)
Figure 4:
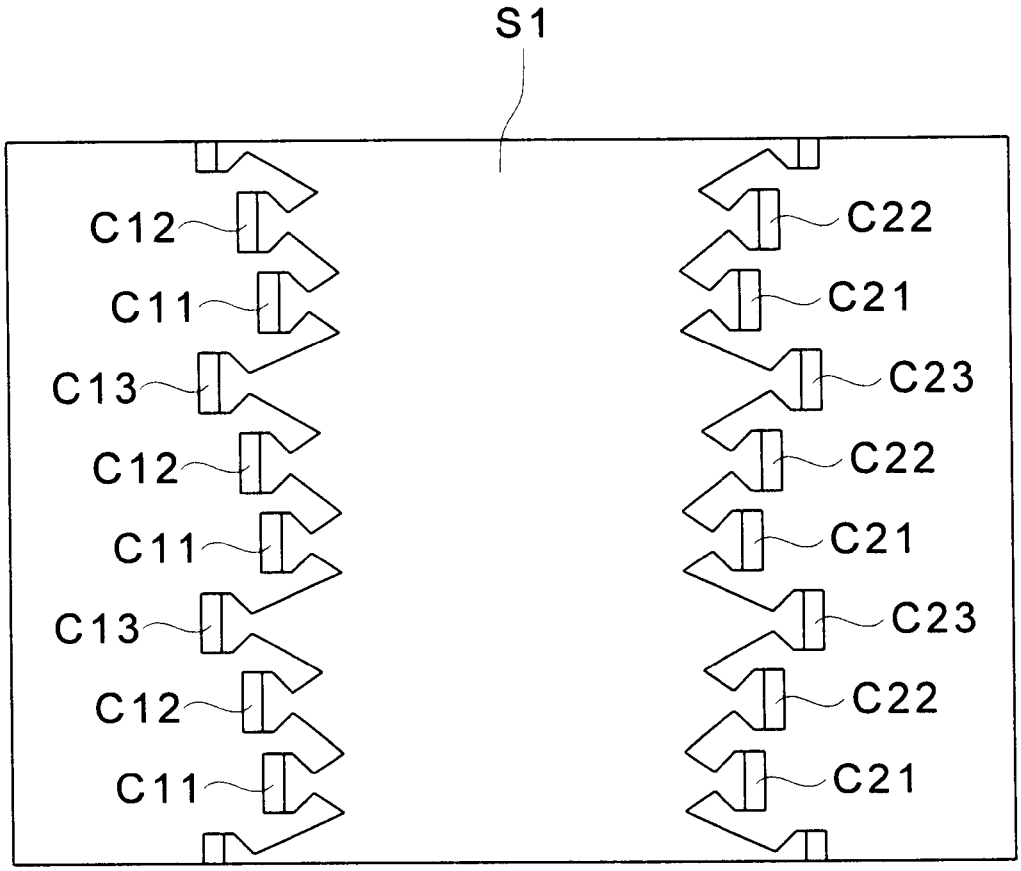
Fig.4 PRIOR ART
FIG. 4 shows a bottom plan view of the conventional inkjet cartridge (3)
Figure 5:
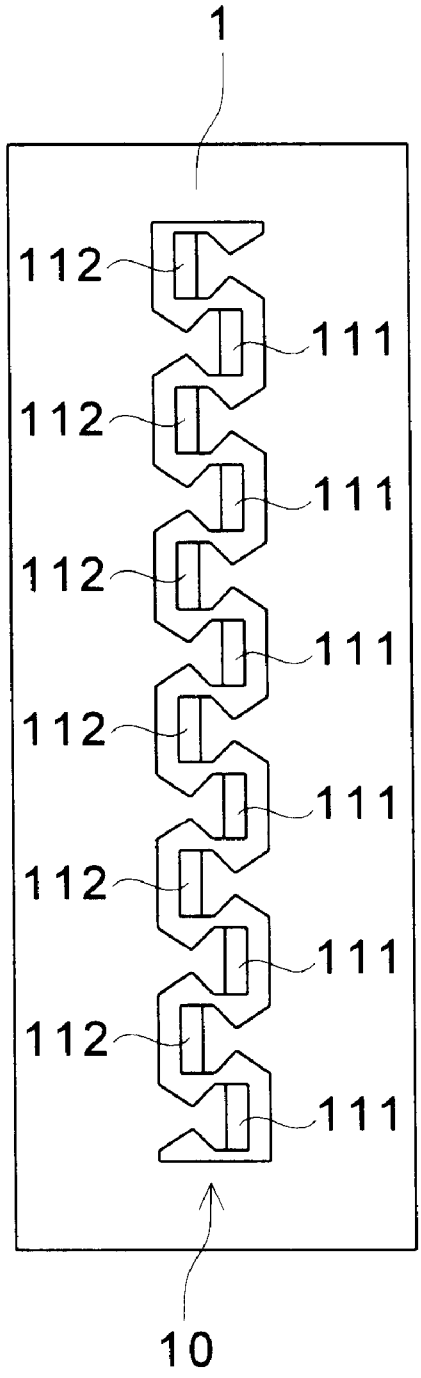
FIG. 5 shows a bottom plan view of the ink chamber structure for an inkjet printhead of the invention.

Please refer to FIG. 5, which shows a bottom plain view of the preferred embodiment for the ink chamber structure 10 for an inkjet printhead of the invention. The ink chamber structure 10 for an inkjet printhead of the invention comprises a plurality of ink chambers 111 and 112 arrayed in column, wherein ink chambers 111 and 112 respectively feature different ink-feeding directions, which is to say, ink chambers 111 and 112 are arrayed as alternating left and right as shown in drawings, and between two adjacent ink chambers 111 (112) on the same side, an ink chamber 112 (111) is arrayed. The ink-feeding direction of the ink chamber 111 is to be from left to right, and ink, with the surface tension thereof, shall be absorbed at the ink nozzles of ink chambers 111 without dripping off. Thus when a printer receives printing signals, ink in ink chambers 111 and 112 is to be ejected out by means of heating or pressuring.

Figure 6:
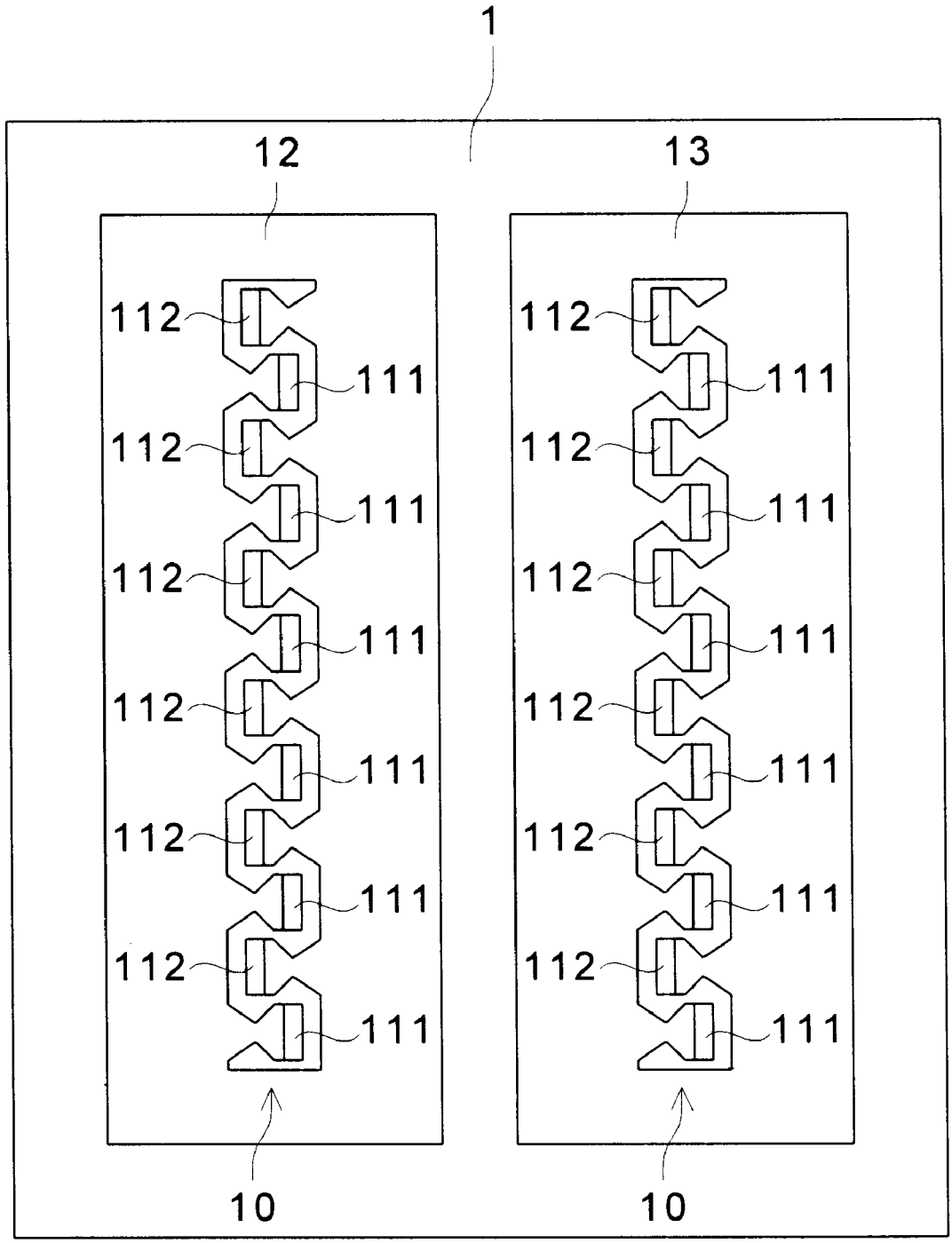
FIG. 6 shows a bottom plan view of the ink chamber structure for an inkjet printhead in another embodiment of the invention.

Another embodiment of the invention is shown in FIG. 6, wherein the inkjet cartridge 1 is installed with two juxtaposed ink-feeding outlets 12 and 13 whereon the foregoing ink chamber structure 10 are respectively formed, thus when a printer receives printing signals, ink in ink chambers 111 and 112 is to be ejected out through means of heating or pressuring to complete the printing process. Through such embodiment, the tightness of arrangement for ink chambers can be further enhanced, thus achieving better ink-jet printing quality.

Figure 7:
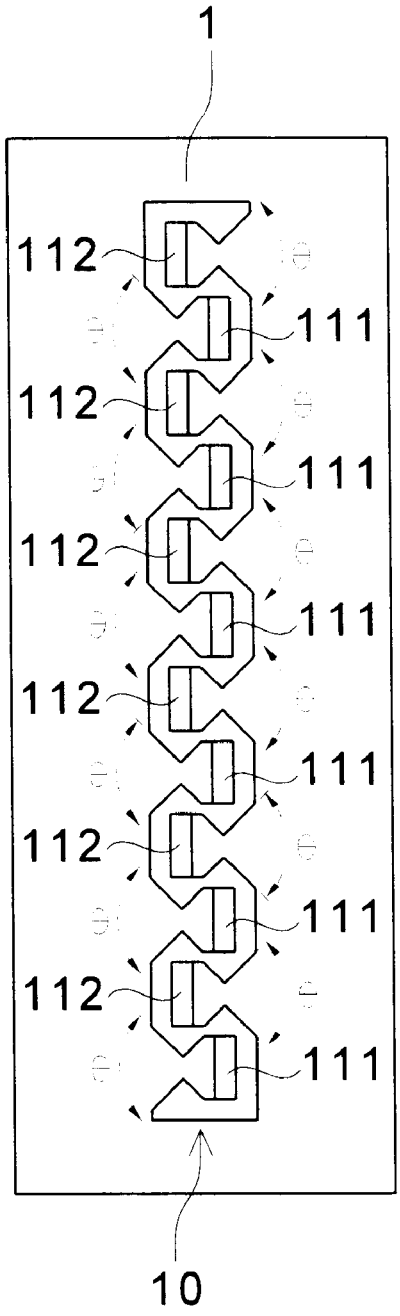
FIG. 7 shows a diagram of the ink-feeding angle of the ink chamber structure for an inkjet printhead of the invention.

Please refer to FIG. 7, wherein the ink-inlet angle θ from ink channels to the ink chambers in the ink chamber structure 10 for an inkjet printhead in the invention can be enlarged; under the circumstance that the adjacent ink chamber 111 not being interfered, the ink-inlet angle can be adjusted to the optimal state, thus reducing the disturbance at the ink inlets to the minimum.

In yet another embodiment of the ink chambers in the ink chamber structure 10 for an inkjet printhead in the invention, the printhead is a thermal bubble inkjet printhead, comprising: a substrate having a major surface; a barrier layer connected to the major surface, having a plurality of ink chambers arrayed in at least one column; a nozzle member, having a plurality of nozzles, with each nozzle corresponding to one ink chamber; a plurality of ink-firing elements installed on the major surface, with each ink-firing element corresponding to one said ink chamber, for ejecting ink out of said ink chamber through said nozzle; and a plurality of ink channels, with each ink channel corresponding to one ink chamber, and the plurality of ink channels respectively channels ink from two sides of such column into ink chambers. The openings for part of the ink chambers are located on one side of the column, whereas the openings for the rest of the ink chambers are located on the other side of the column, with inkjet channels all corresponding to the openings of the ink chambers. The openings of the adjacent ink chambers are installed on two sides of such column installation. Heating members are further installed upon the substrate to respectively correspond to nozzles and ink chambers; such heating member is used as medium for ink-heating purpose, thus ink droplets are to be ejected out from ink chambers through nozzles.

In the preferred embodiment of the invention, the heating member on the substrate is a resistor; by utilizing the resistor to heat ink up, so as to vaporize instantly part of ink in ink chambers, thus generating high-pressure air bubbles to push ink droplets out of nozzles of the nozzle member.

In yet another embodiment of the ink chambers in the ink chamber structure 10 for an inkjet printhead in the invention, the printhead is a piezoelectric-pressure ink-jet printhead, comprising: a substrate having a major surface; a barrier layer connected to the major surface, having a plurality of ink chambers arrayed in at least one column; a nozzle member, having a plurality of nozzles, with each nozzle corresponding to one ink chamber; a plurality of ink-firing elements installed on the major surface, with each ink-firing element corresponding to one said ink chamber, for ejecting ink out of said ink chamber through said nozzle; and a plurality of ink channels, with each ink channel corresponding to one ink chamber, and the plurality of ink channels respectively channels ink from two sides of such column into ink chambers. The openings for part of the ink chambers are located on one side of the column, whereas the openings for the rest of the ink chambers are located on the other side of the column, with ink channels all corresponding respectively to the openings of the ink chambers. The openings of the adjacent ink chambers are installed on two sides of such column installation. Piezoelectric members are further installed upon the substrate to respectively correspond to nozzles and ink chambers; such piezoelectric member is used as medium for ink-pressuring purpose, thus ink droplets are to be ejected out from ink chambers through nozzles.

In the preferred embodiment of the invention, the piezoelectric member is a piezoelectric ceramic that, through applying thereon, voltage to force deformation; thus, by responding to control signal, the deformed piezoelectric ceramic is to compress the volume of ink chamber and eject the droplets with high pressure.

In yet another embodiment of the invention, the ink chamber structure 10 for an inkjet printhead is to be installed in inkjet cartridges, and can be used in ink-jet printing system. Such inkjet cartridge comprises: an ink reservoir having an ink-feeding outlet, used for storing ink; an inkjet printhead, installed at the ink-feeding outlet of the ink reservoir, comprising: a substrate; a barrier layer, having a plurality of ink chambers arrayed in at least one column; a nozzle member, having a plurality of nozzles, with each nozzle corresponding to one ink chamber; and a plurality of ink channels, with each ink channel corresponding to one ink chamber, and the plurality of ink channels respectively channels ink from two sides of such column into ink chambers.

Although the present invention has been described in considerable detail with reference to certain preferred embodiments thereof, those skilled in the art can easily understand that all kinds of alternations and changes can be made within the spirit and scope of the appended claims. Therefore, the spirit and scope of the appended claims should not be limited to the description of the preferred embodiments contained herein.

What is claimed is:

1. An ink chamber structure, comprising:

a plurality of ink chambers arrayed in a column installation;

a plurality of ink channels, with one said ink channel corresponding to an opening of one said ink chamber to form an enlarged ink inlet angle, and said ink channels respectively channels ink from two sides of said column installation into said ink chambers; and wherein said ink channel forms an acute angle θ with the axis of said chamber.

2. The ink chamber structure of claim 1, wherein the openings for part of said ink chambers are located on one side of said column installation, whereas the openings for the rest of said ink chambers are located on the other side of said column installation.

3. The ink chamber structure of claim 1, wherein said ink channels for adjacent ink chambers are respectively located on two sides of said column installation.

4. The ink chamber structure of claim 1, wherein said openings for adjacent ink chambers are respectively disposed on two sides of said column installation.

5. The ink chamber structure of claim 1, wherein each of said ink chambers corresponds to a nozzle and an ink-firing element, whereby ink is to be ejected out of said ink chamber through said nozzle.

6. The ink chamber structure of claim 5, wherein said ink-firing element is a thermal resistor.

7. The ink chamber structure of claim 5, wherein said ink-firing element is a piezoelectric element.

8. An inkjet printhead, comprising:

a substrate having a major surface;

a barrier layer connected to the major surface, having a plurality of ink chambers arrayed in at least one column installation;

a nozzle member, having a plurality of nozzles, with each nozzle corresponding to one said ink chamber;

a plurality of ink-firing elements installed on the major surface, with each ink-firing element corresponding to one said ink chamber, for ejecting ink out of said ink chamber through said nozzle;

a plurality of ink channels, with each of said ink channels corresponding to an opening of one said ink chamber to form an enlarged ink inlet angle, and said plurality of ink channels respectively channels ink from two sides of said column installation into said ink chambers; and wherein said ink channel forms an acute angle θ with the axis of said chamber.

9. The inkjet printhead of claim 8, wherein the openings for part of said ink chambers are located on one side of said column installation, whereas the openings for the rest of said ink chambers are located on the other side of said column installation.

10. The inkjet printhead of claim 8, wherein said ink channels for adjacent ink chambers are respectively located on two sides of said column installation.

11. The inkjet printhead of claim 8, wherein said openings for adjacent ink chambers are respectively disposed on two sides of said column installation.

12. The inkjet printhead of claim 8, wherein ink-firing elements are installed on said substrate to respectively correspond to said nozzles and said ink chambers; said ink-firing elements are to eject ink out of said ink chambers through said nozzles.

* * * * *